United States Patent [19]

Sasaki et al.

[11] 4,019,543

[45] Apr. 26, 1977

[54] METHOD OF FIXING AN END PORTION OF A LINE TO A REEL

[75] Inventors: Kichiro Sasaki, Takatsuki; Kazuo Takeuchi, Suita; Shiro Kazitani, Kobe; Kazuo Shimizu, Kobe; Yoshiteru Yoshida, Kobe, all of Japan

[73] Assignee: Kobe Steel Ltd., Kobe, Japan

[22] Filed: Feb. 25, 1975

[21] Appl. No.: 552,878

[30] Foreign Application Priority Data

Feb. 25, 1974 Japan ..... 49-22047

[52] U.S. Cl. ..... 140/111; 29/432; 29/451; 29/505; 29/525; 242/25 R; 242/125.2; 242/159; 242/164

[51] Int. Cl.[2] ..... B21F 3/027; B65H 75/28

[58] Field of Search ..... 242/125, 125.1, 125.2, 242/74, 77, 77.3, 77.4, 159, 164; 29/432, 432.1, 451, 505, 525; 140/92.2, 111

[56] References Cited

UNITED STATES PATENTS

| | | | |
|---|---|---|---|
| 782,585 | 2/1905 | Sweet | 242/125.1 X |
| 2,958,926 | 11/1960 | Morison | 29/432 X |
| 3,214,114 | 10/1965 | Wilson | 242/164 |
| 3,528,623 | 9/1970 | Peeters | 242/74 |

*Primary Examiner*—Stanley N. Gilreath
*Assistant Examiner*—John M. Jillions
*Attorney, Agent, or Firm*—Oblon, Fisher, Spivak, McClelland & Maier

[57] ABSTRACT

A method of fixing the end portion of a line such as for example, a wire or the like, to a reel by plastically bending the end portion of the line into the form of a U-shaped recession extending transversely to the longitudinal direction of the line, wire or the like and depositing the deformed end portion into a slot provided within the reel.

5 Claims, 17 Drawing Figures

METHOD OF FIXING AN END PORTION OF A LINE TO A REEL

BACKGROUND OF THE INVENTION

1. Field of the Invention

The present invention relates generally to a method of fixing an end portion of a line, such as for example, a wire or the like, to the drum or flange portion of a reel in order to wind the line wire, or the like upon a reel, such as for example, a bobbin, and more particularly to a method of automatically and continuously winding a line upon a reel.

2. Description of the Prior Art

In order to fix an end portion of a line, such as for example, wire or the like, to a reel, there has commonly been employed a method within which, as shown in FIGS. 1 and 2, the end of the line or the like is initially disposed within a slot 4 formed within a convenient portion of one of the flanges 3 provided upon both sides of the winding drum 2 of the bobbin 1 and subsequently, the end portion of the line which has emerged from the slot is bent along the external surface of the flange. Such a method, however, depends upon manual operations and hence exhibits an extremely low efficiency. In addition, although the work is relatively easy in the instance that the line to be handled is of a small size, great difficulties are encountered when dealing with a line of a substantially large size.

In addition, various problems arise when it is attempted to automate such conventional methods. For example, one type of an automatic line end fixing method is known wherein a wedge-like member is employed for facilitating the catching and fastening of the line end, however, this method is quite impractical with respect to labor and cost considerations.

When winding a line, such as for example, wire or the like, it is required, in any case, to fix the end portion of the line to a revolving bobbin or winding head, however the conventional methods have proven to be defective in many respects in accomplishing this goal. For example, when practicing an automatic fixation of the end portion of the line, it is virtually impossible to fix the end of the line directly to the bobbin and hence there has been employed a method whereby the end of the line is fixed to the winding head by employing spring lock, terminal lock or coil spring lock means in addition to other appurtenant mechanisms or attachments.

In the instance of fixing the starting end of the line directly to the bobbin, it has been the practice to plastically bend the end of the line into the form of a hook and to subsequently insert the bent end portion into a slot or other like means formed within the cylindrical drum of the bobbin so as to fix the end portion of the line within such slot. According to this method, however, when the bobbin is rotated so as to start winding of the line, the end portion of the line disposed forward of the inflection point tends to be bent back in the winding direction owing to the tensile forces exerted upon the line, and as a result, the line end becomes dislocated from the slot thus making it impossible to effectively accomplish the secure fixing of the line end to the reel or bobbin.

SUMMARY OF THE INVENTION

Accordingly, it is an object of the present invention to overcome the aforenoted problems of the prior art methods.

Another object of the present invention is to provide a method for securely fixing an end portion of a line, such as for example, wire or the like, to a reel, such as for example, a bobbin.

Still another object of the present invention is to provide a method for automatically fixing an end portion of a line to a reel so as to dispense with any manual operation during the entire line winding operation.

The foregoing and other objects are achieved according to the present invention, through the provision of a method for fixing an end portion of a line, such as for example, a wire or the like, to a reel such as for example, a bobbin, which comprises plastically bending the end portion of the line into the form of a U-shaped recession which extends transversely to the longitudinal direction of the line, and inserting such recessed portion into a slot provided within the reel.

According to another aspect of the present invention, there is provided a line end fixing method which is basically the same as that method described above and further characterized in that a portion of the line near its end is forced into the slot provided within the reel by means of a push rod so as to shape the line end into the form of a U-shaped recession so as to thereby fix the line end to the reel.

According to still another aspect of the present invention, there is also provided a line end fixing method conforming basically to the method noted above and further characterized in that the line end portion is bent into the form of a U-shaped recession concurrently with the cutting of the line and subsequently the thus bent line end is inserted into and fixed within the slot formed within the reel.

It is also contemplated in accordance with the present invention to provide a line end fixing method conforming to the method noted hereinabove and further characterized in that the line end may be directly driven into the reel by means of a push rod so as to shape the line end into a U or other like form or configuration while simultaneously fixing the line end within the reel.

It is further envisaged in accordance with the present invention to provide a line end fixing method similar to that noted above and further characterized in that at least two inflections are provided within the starting end portion of the line such that a part of the starting end will be disposed more forwardly and in the winding direction than the inflection point most remote from the tip of the starting end portion of the line and that such line is inserted and fixed within the slot provided within the drum portion of the reel and subsequently, after a desired length of line has been wound upon the reel, the terminating end of the line is then pushed into a slot provided within a flange of the reel by means of a push rod so as to bend the terminating end portion of the line into the form of a U-shaped recession and thereby fix the same within the reel.

The present invention also provides as another embodiment thereof a line end fixing method which is based upon the above-noted method of the invention and which is further characterized in that after a predetermined length of line has been wound upon the reel, rotation of the reel is stopped and, while holding the line portion, disposed rearwardly of the terminating end portion of the line, in the winding direction by means of a wire holder provided rearwardly of the reel, the terminating end portion of the line is forcibly inserted and fixed within a slot provided within a flange of the reel by means of a push rod and at the same time the terminating end portion of the line is also severed by means of a cutter.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIG. 1 is a front view of a bobbin illustrating a conventional method of fixing the terminating end portion of a line, such as for example, wire or the like;

DETAILED DESCRIPTION OF THE PREFERRED EMBODIMENTS

Figure 1:
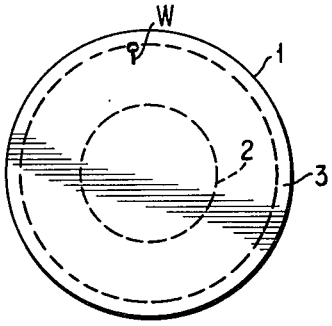
Figure 2:
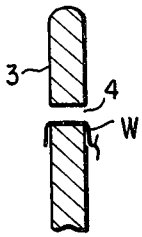
FIG. 2 is an enlarged sectional view showing the fixed line portion of the wire within the bobbin shown in FIG. 1.
Figure 3:
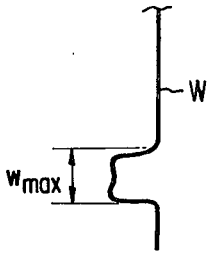
FIG. 3 is an illustrative drawing showing a line end which has been bent into the form of a substantially U-shaped recession by the method of the present invention.
Figure 4:
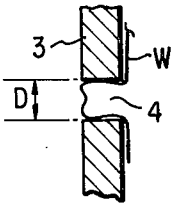
FIG. 4 is a view similar to that of FIG. 2 showing however the condition in which the bent line end shown in FIG. 3 has been inserted and fixed within a reel.
Figure 5:
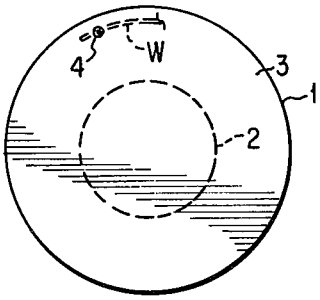
FIG. 5 is a front view of a bobbin similar to that of FIG. 1, showing however the condition wherein the terminating end of a line, such as for example a wire or such has been fixed to the bobbin according to the method of the present invention.

Referring now to the drawings and more particularly to FIGS. 3 and 4 thereof, according to the general conception of the present invention, an end part of a wire W is plastically bent so as to form a substantially U-shaped recession within such end portion of the line, the recession extending transversely to the longitudinal direction of the wire and having a maximum width $w_{max}$ which is slightly greater than the inner diameter D of the slot 4 formed within the reel. The bent portion of the wire is then forcibly inserted into the slot 4 so that the bent portion is elastically pressed against the inner wall surface of the slot and thereby fixed therein as shown in FIG. 4. As a result, the bent end portion of the wire can be securely fixed within the slot of the reel.

In accordance with the aforenoted method, the U-shaped bent portion having a greater width than the inner diameter of the fixing slot is elastically deformed as the same is inserted into the slot and is pressed against the inner wall of the slot as a result of the elasticity or restoring force of such bent wire portion and thereby fixed within the reel. However, it is also possible to shape the bent portion so as to have a width substantially equal to the inner diameter of the slit and then fix such bent portion within the slot of the reel as a result of the frictional contact with the inner wall portion defining the slot.

It should be noted that the method provided in accordance with the present invention for fixing an end portion of a wire to a reel can be employed either for fixing the starting end portion of the wire to a drum or flange portion of a reel, such as for example, a bobbin, or for fixing the terminating end portion of the wire to the flange portion of a bobbin. Employment of the method of the present invention for fixing the terminating end portion of a wire to the bobbin flange of course results in the beneficial effect of realizing automation of the line, particularly metal wire, winding operations.

Figure 6:
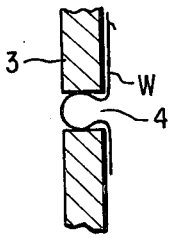
FIGS. 6 and 7 are views similar to that of FIG. 4, illustrating however modified examples of the wire W as inserted according to the method of the present invention.
Figure 7:
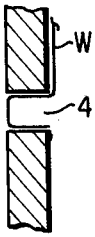

Referring now to FIGS. 6 and 7, there are shown different forms of the bent portion of the line end, and in the case of the embodiment of FIG. 6, the line end portion is plastically bent into the form of a substantially circular recession, while in the case of the embodiment of FIG. 7, the line end portion is plastically bent so as to have a configuration which virtually matches the configuration and size of the slot 4 and wherein an extra linear projecting portion at the tip of the wire is not formed. In both cases, similar effects are obtained so as to provide a secure fixation of the wire within the reel. In addition, in both cases disclosed within FIGS. 6 and 7, it is possible to employ either an elastic pressure fit or a mere frictional contact fit. It should also be noted that while the slot provided within the drum or flange of the bobbin is shown in the drawings as being circular in cross-sectional configuration the slot may of course be of other convenient cross-sectional configurations, such as for example, rectangular. In accordance with the present invention, then, it is possible to employ a slot of virtually any shape provided that it has substantially uniform diameter along the length thereof.

In practicing the method of the present invention, a cutter and bender unit is provided to the rear of the bobbin upon which a line, such as for example, a wire or the like is to be wound, while a pusher unit is disposed at a suitable location above the bobbin, and when the line or the like, fed in accordance with the present invention has been wound upon the bobbin and has attained a predetermined volume, the cutter and bender unit is operated so as to sever the continuous line or wire while at the same time bending the terminal end portion of the cut line so as to form a u-shaped recession within such end portion. The rotation of the bobbin is then stopped and the pusher is lowered and then moved laterally so as to push the bent portion of the line into the slot within the bobbin flange and thereby fix the bent portion therewithin.

Upon completion of such fixing step, the pusher is returned to its original position and the bobbin upon which the line has been duly wound is replaced by a new empty bobbin, whereby the line feeding operation is again performed. At this time, the starting end of the line is fastened to the drum of the empty bobbin in the aforenoted manner for facilitating winding of the line thereon, and the entire operation is carried out repetitively. The pusher and cutter and bender mechanisms employed within the automatic fixing apparatus of the present invention may be mounted directly to the bobbin adjacent the fixing slot and may be detached therefrom when the bobbins are exchanged.

Figure 8A:
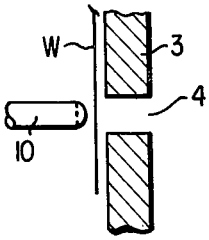
FIGS. 8*a* and 8*b* are views similar to that of FIG. 4, illustrating however another embodiment of the wire inserting method of the present invention.
Figure 8B:
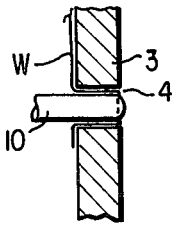

With reference now being made to FIGS. 8*a* and 8*b*, it will be seen that the terminal end of the wire W may be forcibly pushed or inserted into the slot 4 provided within the flange portion 3 of the reel 1 by means of a push rod 10 whereby the initially linear wire end portion can be bent so as to attain a U-shaped configuration and simultaneously fixed within the slot. The push rod, as shown in the FIGURES by means of the dotted lines, is preferably provided with a groove at the end thereof and within which the wire is securely received so as to retain the wire while the same is being inserted within the slot.

Figure 9A:
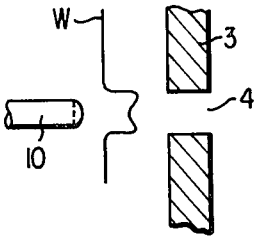
FIGS. 9*a* and 9*b* are views similar to that of FIG. 4 illustrating however still another embodiment of the wire inserting method of the present invention.
Figure 9B:
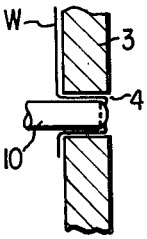

Still another embodiment of the present invention is illustrated within FIGS. 9*a* and 9*b* according to which the end of the wire W is plastically bent into the form of a U-shaped recession simultaneously with the cutting of the wire and subsequently, the bent wire end portion is inserted and fixed within the slot 4 of the flange portion 3 of the reel 1 by means of the push rod 10.

Figure 10A:
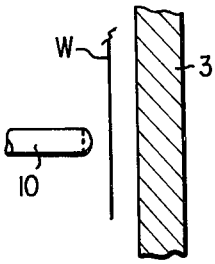
FIGS. 10*a* and 10*b* are views similar to that of FIG. 4 which show yet another embodiment of the wire inserting method of the present invention.
Figure 10B:
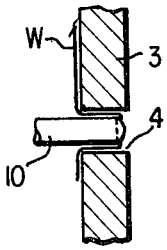
Figure 11:
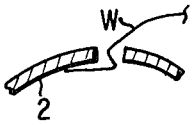
FIG. 11 is an enlarged radial sectional view showing one mode of inserting and fixing the starting end of a line, such as for example, a wire or the like within the slot or opening formed within the drum portion of a bobbin according to the method of the present invention.

With each of the foregoing embodiments, a wire end fixing slot has of course been previously provided within the flange portion of the bobbin, however, in the instance of fixing the wire end portion to a bobbin made of plastic or to a bobbin made of relatively easily workable material, it is not always necessary to pre-fabricate the slot or opening within the bobbin, and instead, the linear wire end which has not yet been bent may in fact be bent and simultaneously driven into and inserted within the flange by means of a push rod 10, as shown for example within FIGS. 10*a* and 10*b*, whereby the slot 4 has also been simultaneously formed with the bending and inserting of the wire end portion within the reel flange, by means of rod 10.

In the instance of fixing the starting end portion of the wire to the drum portion of a reel, the wire end portion is preferably provided with two or more inflections such that at least a part of the wire end portion will be positioned more forwardly and in the wire winding direction than the inflection point which is located most remote from the tip of the starting end portion of the wire whereby the bent portion of the wire is able to be inserted into the slot formed within the drum portion 2 of the reel 1 so that the foremost end of the wire is able to be pressed against the inner peripheral surface of the cylindrical drum by means of the torque which is produced and acts about the fixing or engaging point of the wire at the wall portion of the drum defining the slot as a result of the tensile forces exerted upon the wire. This permits the simple and secure fixing of the wire end to the reel so as to realize automation of the starting step within the wire winding operation. In summary, if this fixing method is employed for fixing the starting end portion of the wire while the terminal end portion thereof is fixed to the reel by bending it in the aforenoted manner, the entire winding operation can be accomplished automatically so as to realize a substantial saving in labor and render the wire winding operation more efficient.

An example of winding apparatus for winding a line, such as for example, a wire or the like, hereinafter referred to generically as wire, upon a reel or bobbin, will now be disclosed for practicing the method of the present invention, reference being made to FIGS. 12–14. Within such FIGURES, there is shown a wire winding device equipped with means for fixing the terminal end portion of the wire W upon a reel 1 or the like, hereinafter referred to representatively as a bobbin. This bobbin 1 is held in position by a pair of bobbin holders BH and BH′, and one of the bobbin holders BH is connected to a driving power source, not shown, while the other bobbin holder BH′ is rotatably supported so as to be longitudinally movable with respect to the opposed holder BH. With the bobbin 1 being held in position by and between the pair of bobbin holders BH and BH′, the driven bobbin holder BH is subsequently rotated by means of the power source so as to rotate the bobbin 1 and wind up the wire W thereon.

A wire holder generally indicated by the reference character WH is mounted upon a traverser 5 and the wire holder WH is provided with a pair of holding rollers 6 and 7 which are arranged to hold a portion of the wire W fed from a stock roller, not shown, and to be wound upon the bobbin 1. One of the holding rollers 6 is secured to a longitudinally movable frame 8 while the other holding roller 7 is coupled to a fluid pressure cylinder 9 mounted upon movable frame 8 and which is transversely movable with respect to the fixed roller 6 and wire W. The movable frame 8, thus equipped with the pair of holding rollers 6 and 7, is slidably arranged upon a guide rail G, fixed upon the traverser 5 so as to extend in the wire feeding direction, and is also coupled to a fluid pressure cylinder 11 secured to the rear end of the traverser 5, thereby allowing the wire holder WH to move longitudinally in the direction of wire W and along guide rail G.

The traverser 5 is driven by means of a suitable driving means, not shown, so as to reciprocate upon a mount or support 12 with a stroke corresponding to the length of drum 2 of bobbin 1 in the direction transverse of the wire feeding direction whereby the wire W may be wound upon the reel over the entire portion thereof. At both ends of traverser 5 there are provided support rollers 13 and 14, and at the front end thereof there is also pivotably secured a rocker arm 17 which is provided with support rollers 15 and 16, whereby the wire can be effectively directed to a predetermined position, rocker arm 17 being operated by means of a fluid pressure cylinder 18 which is interposed between arm 17 and traverser 5.

In front of rocker arm 17 yet slightly behind bobbin 1 there is also provided a cutter 19 for cutting the terminal end portion of the wound-up wire, and still further, in combination with cutter 19 there is also provided a bender 20, whereby the terminal end of the wire is cut and at the same time bent into a suitable configuration for permitting the securing of the next starting end portion of the wire. The cutter and bender mechanisms are operated by means of a fluid pressure cylinder 21 secured to an upper girder 28.

Positioned in front of cutter 19 and immediately above bobbin 1 is a pusher mechanism generally indicated by the reference character 22 which is adapted for forcibly inserting and bending the terminal end portion of the wire into the slot 4 which is provided within a peripheral portion of the flange portion 3 of bobbin 1. This pusher 22 is provided with a push rod 10 which is laterally movable so as to directly force its way into slot 4.

Figure 14:
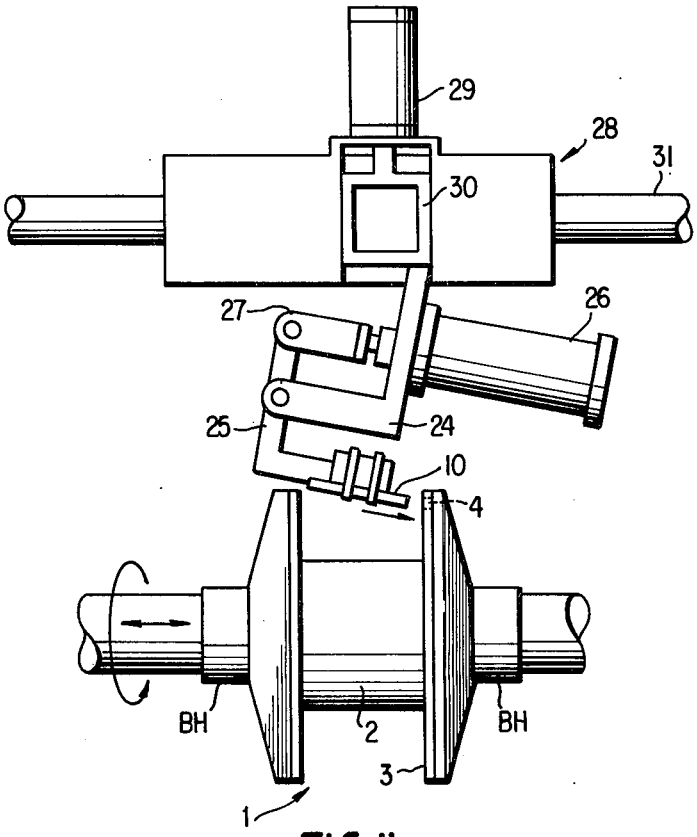
FIG. 14 is a partial side elevation view of the apparatus of FIG. 12.

As best shown in FIG. 14, push rod 10 is secured to one end of a substantially L-shaped operating arm 25 which is pivoted to a frame 24, the other end of arm 25 being connected through means of a lever 27 to a fluid pressure cylinder 26 which is also mounted to frame 24, push rod 10 being moved along a slightly inclined path into slot 4 as a result of the operation of cylinder 26. Frame 24 is in turn suspended from a frame 30 which is vertically movable within girder 38 through means of a fluid pressure cylinder 29 so that push rod 10 may normally, that is, when not in operation, be maintained retracted to its upper position so as to be removed from the area within which bobbin 1 is disposed and thereby not interfere with the wire winding operation.

The girder 28 is likewise slidably mounted upon a beam 31 extending transversely to the wire feed direction and is arranged so as to be laterally movable by means of the operation of a suitable driving means, not shown, so as to move cutter 19 and bender 20 as desired.

A guide member 32 is also provided whereby the starting end portion of the wire bent by means of bender 20 is able to be positively guided and inserted into the fixing slot or opening provided within the drum or flange of the bobbin and this guide member can be tilted or pivoted toward the drum by means of a cylinder 33.

In operation of the above-described apparatus, the bobbin 1 is initially set in position by means of the bobbin holders BH and BH′ and then wire W is supplied from the stock roller, not shown. The wire is guided by means of the support roller 13 and is passed between the holding rollers 6 and 7 of the wire holder WH, the holding rollers being maintained separated from each other during this period, and then between the support rollers 14 and further through the support rollers 15 and 16.

Subsequently, the girder 28 is moved so as to dispose the bender 20 at a position close to the inner surface of the bobbin flange, and the leading end of the wire is then guided into the bender 20. At this point, the wire holder WH is operated so as to fixedly hold the major portion of the fed wire and subsequently the cylinder 21 is operated so as to actuate bender device 20 and bend the wire and end portion. Thereafter, the rocker arm 17 and guide member 32 are tilted to the appropriate positions and the wire holder WH is advanced upon the traverser 5 whereby the wire is guided by means of guide member 32 so as to enter the starting end fixing slot.

Figure 12:
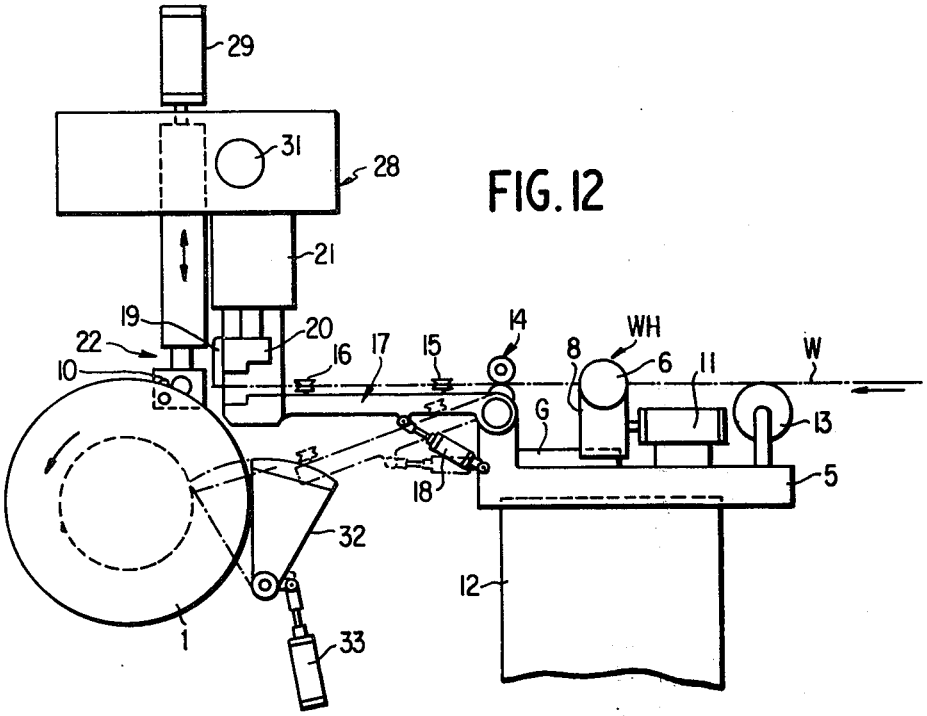
FIG. 12 is a schematic front view of a wire winding apparatus equipped with means for fixing the starting and terminating ends of a wire according to the method of the present invention.
Figure 13:
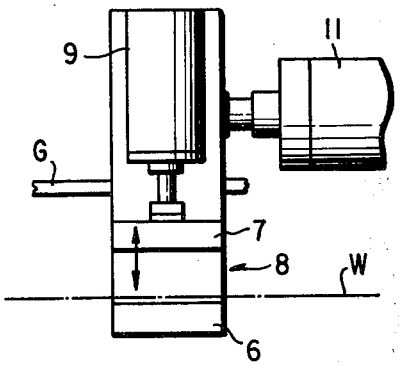
FIG. 13 is an enlarged plan view of the wire holder apparatus of the system apparatus shown in FIG. 12.

The bobbin holder BH is then driven so as to rotate the bobbin 1 in the direction of the arrow as seen in FIG. 12 whereby the wire with its starting end fixed within the fixing slot is wound upon the drum. The traverser 5 is reciprocated at a predetermined speed in conjunction with the start of the rotation of the bobbin and when the starting end portion of the wire has been duly fixed to the bobbin, the girder 28 and guide member 32 are returned to their original positions. Likewise, the wire holder WH is released so as to permit the same to move back to its original position, while the rocker arm 17 is also slowly raised as the wire is wound upon the bobbin and is in fact returned to its original parallel position upon completion of the winding operation of the wire.

After a predetermined volume of wire has been wound upon bobbon 1, the rotational actuation of bobbin holder BH is terminated so as to thereby stop rotation of the bobbin, and at this point, the wire holder is again operated to hold and fix the wire between the holding rollers 6 and 7, and subsequently girder 28 is again moved while the pusher 22 is lowered in order to dispose the push rod 10 at a predetermined location. Under these conditions, the fixing slot 4 within flange 3 is detected by means of a suitable detecting means, such as for example, a phototube, and disposed in axial alignment with the push rod 10, while the terminating end portion of the wire is interposed between the slot 4 and the rod 10.

The driving cylinder 26 of pusher 22 is then operated so as to actuate the push rod 10 in order to plunge the same into the slot 4 whereby the terminating end portion of the wire is in fact bent and inserted into and fixed within the slot. Cylinder 21 is then operated so as to cut the end of the thus fixed terminating end portion of the wire while at the same time the starting end portion of the succeeding wire is bent into a predetermined shape by means of the bender 20. Thereafter, the full bobbin is removed and a new empty bobbin is set in the winding disposition, whereby the above-noted operation is repeated.

In the foregoing embodiment, the terminating end portion of the wire is inserted and fixed within the slot which has been previously formed within the flange portion of the bobbin, however, as noted heretofore, in the instance that the bobbin is made of certain types of material, it is not necessary to so form the slot and in fact, the terminating end portion of the wire may be directly driven into the bobbin flange by means of the push rod which also simultaneously forms the slot. In the latter case, there is also no need for detecting the position of the wire end fixing slot within the bobbin flange and hence the winding operation is further simplified.

Thus, it may be seen that the wire end fixing method of the present invention, as described above by way of the noted embodiments, has important advantages over the known prior art methods in that when a predetermined length of line, such as for example wire or the like, has been wound upon a bobbin, rotation of the bobbin is stopped and, while holding the remaining portion of the wire behind the terminating end portion thereof by means of a wire holder on a traverser, the terminating end portion of the wire is forcibly bent and pushed into a slot which may be previously formed within a flange of the bobbin, by means of a push rod of a pusher or alternatively, the same may be directly driven into the flange so as to thereby fix the wire end portion to the flange. The thus fixed terminating end portion of the wire is then cut by means of a cutter, so that, according to the present invention, bending of the terminating end portion of the wire and the fixing thereof to the bobbin flange can be accomplished simultaneously and further, subsequent to the cutting step, the succeeding wire will not become loose or disorderly due to the holding operation of the remaining portion of the wire, and thus, the present invention allows for the secure fixing of the terminating end of the wire at an extremely high efficiency rate and is greatly conducive to automation of the wire winding operation.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A method of fixing a wind-terminating end portion of a wound metal wire to a flange portion of a reel comprising the steps of:

stopping the rotation of said reel after a predetermined amount of wire has been wound upon said reel;

fixedly holding the rear portion of said wire;

plastically bending said wind-terminating end portion of said wire so as to form a substantially U-shaped recession within said wind-terminating end portion of said wire which extends transversely to the longitudinal direction of said wire;

disposing said bent wind-terminating end portion of said wire within a groove provided within the end of a means for inserting said wind-terminating end portion of said wire within said flange portion of said reel so as to facilitate the guidance of said wind-terminating portion of said wire during said insertion thereof within said reel;

moving said inserting means so as to insert said U-shaped recessed portion of said wire into an appropriately configured slot provided within said flange portion of said reel; and cutting said wind-terminating end portion of said wire.

2. A line end fixing method according to claim 1, wherein:

said insertion of said wind-terminating end portion of said wire into said slot within said reel and said bending of said wind-terminating end portion of said wire into the form of a U-shaped recession are performed by said inserting means which comprises a push rod; and said recessed portion of said wire is inserted within said slot of said reel simultaneously with said bending step.

3. A line end fixing method according to claim 1, wherein:

said bending of said wind-terminating end portion into the form of a U-shaped recession is performed simultaneously with the cutting of said wire; and said insertion of said U-shaped line end portion within said slot of said reel is performed by means of said insertion means which comprises a push rod.

4. A line end fixing method according to claim 1, wherein:

said wind-terminating end portion of said wire is inserted into said reel by means of said insertion means which comprises a push rod which simultaneously bends and inserts said wind-terminating end portion within said reel as said push rod also forms said slot within said reel.

5. A line end fixing method according to claim 1, further comprising:

providing a starting end portion of said wire with at least two inflections such that at least a part of said starting end portion of said wire will be disposed forwardly and in the wire winding direction than said inflection which is located most remote from the foremost end of said starting end portion of said wire; and inserting the bent starting end portion of said wire within a slot provided within the drum portion of said reel.

* * * * *